US005820638A

United States Patent [19]

Houser et al.

[11] Patent Number: 5,820,638

[45] **Date of Patent: *Oct. 13, 1998**

[54] STAIN BLOCKING AGENT

[75] Inventors: Nelson E. Houser, Greensboro; James F. Leuck, Gibsonville; Thomas J. Balchin, Graham, all of N.C.

[73] Assignee: Burlington Chemical Co., Inc., Burlington, N.C.

[ * ] Notice: This patent issued on a continued prosecution application filed under 37 CFR 1.53(d), and is subject to the twenty year patent term provisions of 35 U.S.C. 154(a)(2).

[21] Appl. No.: 668,352

[22] Filed: Jun. 26, 1996

[51] Int. Cl.[6] ..... D06P 1/52; D06P 3/82

[52] U.S. Cl. ..... 8/532; 8/553; 8/543

[58] Field of Search ..... 8/532, 553, 543–549; 524/808

[56] References Cited

U.S. PATENT DOCUMENTS

| | | | |
|---|---|---|---|
| 2,903,325 | 9/1959 | Geigy | 8/553 |
| 2,955,011 | 10/1960 | Riegel | 8/553 |
| 2,959,461 | 11/1960 | Murray | 8/553 |
| 4,330,451 | 5/1982 | Straub et al. | 524/458 |
| 4,369,040 | 1/1983 | Kirner et al. | 8/527 |
| 4,448,581 | 5/1984 | Fennekels et al. | 8/553 |
| 4,554,312 | 11/1985 | Barabas et al. | 524/808 |
| 5,490,866 | 2/1996 | Gieth | 8/549 |

*Primary Examiner*—Margaret Einsmann

*Attorney, Agent, or Firm*—Rhodes Coats & Bennett, L.L.P.

[57] ABSTRACT

A composition for the elimination of cellulosic dye cross staining when dyeing cellulosic and synthetic blended fabrics in a dye bath. The composition includes a first component including polyvinylpyrrolidone polymer having a mwt. of between about 15,000 to 40,000 and the balance water. In the preferred embodiment, the composition includes a second component including dyestuff including dyes and polyvinylpyrrolidone polymer. Dyeing textile articles having at least two different types of fibers selected from the group consisting of cellulosic and synthetic fibers using the present invention produce a dyed article in which the cellulosic fibers are dyed and the synthetic fibers have a Class Value of greater than about 3 when measured according to the AATCC Gray Scale for Color Change.

11 Claims, No Drawings

STAIN BLOCKING AGENT

BACKGROUND OF THE INVENTION (1) Field of the Invention

The present invention relates generally to the dyeing of textiles and, more particularly, to the elimination of cellulosic dye cross staining when dyeing cellulosic and acetate or polyester blended fabrics.

(2) Description of the Prior Art

Dyes are add color to textiles. They are incorporated into the textile fibers by chemical reaction, absorption or dispersion. Dyes differ in their resistance to sunlight, perspiration, washing, alkalies and other agents; their affinity for different fibers; their reaction to cleaning agents and methods; and their solubility and method of application.

Cellulosic fibers may be dyed with Direct, Fiber Reactive, Sulfur and Vat dyes. Synthetics are normally dyed with Disperse, Cationic or Acid dyes. *Polymers: Fibers and Textiles, A Compendium,* John Wiley and Sons (1990).

Direct dyes are a class of dyestuffs that are applied directly to the fabric substrate in a neutral or slightly alkaline dye bath. They produce full shades on cotton and linen without mordanting and can also be applied to rayon, silk and wool. Direct dyes produce bright shades but exhibit poor washfastness. *Dictionary of Fiber & Textile Technology,* Hoechst Celanese Corporation (1990).

Fiber reactive dyes were first introduced in 1956. Since that time they have become a dominant factor in dyeing cotton, regenerated cellulose and blends. These dyes can also be used to dye acrylics, nylon, silk, and wool and blends of these fibers. Fiber reactive dyes are easy to apply and produce brilliant shades, fastness, penetration and leveling.

Fiber reactive dyes are anionic in nature and react chemically with the fiber. The dyes include a chromophore to give color to the dye and a reactive group to form a chemical bond with the fiber. There may also be a substitutent or solubilizing group which provides additional dyeing characteristics such as solubility, substantivity, migration, washing off, etc. Fiber reactive dyes react in the presence of alkali to form a strong covalent chemical bond between a carbon atom of the dye molecule and an oxygen atom of the hydroxyl group in the cellulose. This step is called "fixing".

Blended fabrics of cellulosic fibers (cotton, rayon) and synthetic fibers (polyester, acetate, nylon, acrylic) can be designed in patterns where the cotton is dyed and the synthetic remains pure white or dyed another color other than the color used on the cellulose portion. If the synthetic portion of the fiber is stained with fiber reactive or direct dye used for dyeing the cellulose portion, the synthetic portion can look dirty, dingy and sharp crisp patterns do not result. This ability to "reserve" the synthetic portion of the fabric adds value to fabrics produced for upholstery, apparel, automotive and home furnishings.

Various polymers have been tried for reserving agents including polymers manufactured from epichlorohydryn, dialkylamine quaternaries, ethoxylated alkyl mono and di amines, and quaternaries compounds manufactured from these amines. Ethoxylated tertiary amines are known to aid in reserving synthetic fibers and such products are sold in the textile trade as reserving, dye leveling and compatabilizing agents. Examples listed in the 1995 AATCC Buyers guide are: Burco™ PL, Sandogen™ NH and others. These products are not suitable for reserving the synthetic fibers to pure white and nonstained when direct or fiber reactive dyes were used to dye the cellulose portion of the fabric.

Thus, there remains a need for a reserving agent for use in fiber reactive and direct dyeing of cotton and cotton blended fabrics which eliminates cellulosic dye cross staining when dyeing cellulosic and acetate or polyester blended fabrics.

SUMMARY OF THE INVENTION

The present invention is directed to a composition for the elimination of cellulosic dye cross staining when dyeing cellulosic and synthetic blended fabrics in a dye bath. The composition includes a first component including polyvinylpyrrolidone polymer having a mwt. of between about 15,000 to 40,000 and the balance water. In the preferred embodiment, the composition includes a second component including dyestuff including dyes and polyvinylpyrrolidone polymer.

Preferably, the dyes are selected from the group consisting of direct and fiber reactive dyes and the polyvinylpyrrolidone polymer has a mwt. of between about 15,000 to 40,000.

Also, preferably, the polyvinylpyrrolidone polymer in the first component is between about 0.1 to 30 wt % and the balance is water and the polyvinylpyrrolidone polymer in the second component is between about 0.1 to 10 wt % and the balance is dye.

The first component may include up to 99.9 wt % of a nonionic surfactant. The surfactant preferably is selected from the group consisting of alcohol ethoxylates, alcohol ethoxylate propoxylates, tert-amine ethoxylates and amphoteric surfactants including amino carboxylates, betaines, and imidazolines. Finally, the pH of the composition can be adjusted to between about 3 to 9.

During dyeing of the textile articles, the polyvinylpyrrolidone polymer in the first component is between about 0.1 to 0.5 wt % based on the weight of goods and conventional amounts of the second component is used for dyeing.

Accordingly, one aspect of the present invention is to provide a composition for the elimination of cellulosic dye cross staining when dyeing cellulosic and synthetic blended fabrics in a dye bath, the composition including: (a) a polyvinylpyrrolidone polymer; and (b) the balance water.

Another aspect of the present invention is to provide a composition for the elimination of cellulosic dye cross staining when dyeing cellulosic and synthetic blended fabrics in a dye bath, the composition including: (a) a polyvinylpyrrolidone polymer having a mwt. of between about 15,000 to 40,000; and (b) the balance water.

Still another aspect of the present invention is to provide a composition for the elimination of cellulosic dye cross staining when dyeing cellulosic and synthetic blended fabrics in a dye bath, the composition including: (a) a first component including polyvinylpyrrolidone polymer having a mwt. of between about 15,000 to 40,000 and the balance water; and (b) a second component including dyestuff including dyes and polyvinylpyrrolidone polymer.

These and other aspects of the present invention will become apparent to those skilled in the art after a reading of the following description of the preferred embodiment.

DESCRIPTION OF THE PREFERRED EMBODIMENTS

Various cationic polymers were screened for the ability to eliminate cross staining on synthetic fibers when dyeing cellulose/synthetic blends in a single bath or two-bath process. This included polymers manufactured from epichlorohydryn, dialkylamine quaternaries, ethoxylated alkyl mono and di amines, and quaternaries compounds manufactured from these amines. Ethoxylated tertiary amines are known to aid in reserving synthetic fibers and such products are sold in the textile trade as reserving, dye leveling and compatabilizing agents. However, these products were not found suitable for reserving the synthetic fibers to pure white and nonstained when direct or fiber reactive dyes were used to dye the cellulose portion of the fabric.

A cationic polymer found suitable was a polymer of vinyl pyrol. Such a polymer is sold by International Speciality Products of Wayne, N.J. as polyvinylpyrrolidone (PVP) under the tradename Gaftex PVP K30. This polymer is manufactured in both a liquid and solid form and, therefore, can be formulated into both a liquid product that could be added directly to a textile dye bath and also could be mixed as a dry powder in the manufacturing and standardization process for powder dyes.

It was surprisingly discovered that the "reserving" effect of the PVP was further improved when the PVP was added both as a liquid additive and as a powdered dyestuff additive.

The reserving effect was evaluated after dyeing using the AATCC Gray Scale for Color Change to determine the resistance to cross staining as follows:

Class 5 negligible or no change as shown in Gray Scale Step 5;

Class 4 a change in color equivalent to Gray Scale Step 4;

Class 3 a change in color equivalent to Gray Scale Step 3;

Class 2 a change in color equivalent to Gray Scale Step 2; and

Class 1 a change in color equivalent to Gray Scale Step 1.

Generally, Classes 4 and 5 are considered to be commercially acceptable while Classes 1–3 are considered unacceptable.

In the preferred embodiment, the method for elimination of cellulosic dye cross staining when dyeing cellulosic and synthetic blended fabrics in a dye bath, includes the steps of: adding a first component including polyvinylpyrrolidone polymer having a mwt. of between about 15,000 to 40,000 to the dyebath; and adding a second component including dyestuff including dyes and polyvinylpyrrolidone polymer to the dyebath. In an alternative embodiment, the method includes only adding the first component to the dyebath.

The present invention can best be understood after a review of the following examples.

EXAMPLES 1–6

Conventional direct and reaction dyeings of cotton and acetate or polyester fabrics were made to determine the cross staining of the candidate materials. The dyes selected were Procion™ Red HE7B, Reactive Red 141, and Procion™ Red HE3B, Reactive Red 120. These dyes are Monochlortriazine dyes and are available from ICI America of Wilmington, Del. Suitability as a reserving agent was measured on a scale of 1–5 with 5 being best.

TABLE 1

Polymer Screening Dye Trial Results

| Example | Polymer | Suitability |
|---|---|---|
| 1 | epichlorohydryn | 1 |
| 2 | dialkylamine quaternaries | 1 |
| 3 | ethoxylated alkyl mono amines | 3 |

TABLE 1-continued

Polymer Screening Dye Trial Results

| Example | Polymer | Suitability |
|---|---|---|
| 4 | ethoxylated alkyl di amines | 3 |
| 5 | ethoxylated amine quaternaries | 2 |
| 6 | vinyl pyrol (present invention) | 5 |

These results clearly show that the present invention provides the highest resistance to cross staining. Ethoxylated mono and di amines were found to aid in reserving the synthetic fibers. However, these polymers are not suitable for reserving the synthetic fibers to pure white and nonstained when direct or fiber reactive dyes were used to dye the cellulosic portion of the fabric.

EXAMPLES 7–11

Conventional direct and reaction dyeings of cotton and acetate or polyester fabrics were made to determine the cross staining of a range of mwt. of polymers of the present invention. Suitability as a reserving agent was measured on a scale of 1–5 with 5 being best.

TABLE 2

Polymer Mwt. Dye Trial Results

| Example | Polymer Mwt. | Suitability |
|---|---|---|
| 7 | 15,000 | 4 |
| 8 | 30,000 | 5 |
| 9 | 40,000 | 4 |
| 10 | 60,000 | 3 |
| 11 | 90,000 | 2 |

These results clearly show that polymer of the present invention having a mwt. between about 15,000 to 40,000 provides the highest resistance to cross staining.

EXAMPLES 12–22

Conventional direct and reaction dyeings of cotton and acetate or polyester fabrics were made to determine the cross staining of a range of wt %. of polymer in the first component of the present invention. Suitability as a reserving agent was measured on a scale of 1–5 with 5 being best.

TABLE 3

Polymer Wt % (1st Component) Dye Trial Results

| Example | Polymer Wt % | Suitability |
|---|---|---|
| 12 | 0.0 | 1 |
| 13 | 0.1 | 4 |
| 14 | 0.5 | 4 |
| 15 | 1.0 | 5 |
| 16 | 5.0 | 5 |
| 17 | 10.0 | 5 |
| 18 | 15.0 | 5 |
| 19 | 25.0 | 5 |
| 20 | 30.0 | 4 |
| 21 | 35.0 | 3 |
| 22 | 40.0 | 2 |

These results clearly show that a polymer of the present invention in the first component having a wt % between about 0.1 to 30 provides the highest resistance to cross staining.

EXAMPLES 23–29

Conventional direct and reaction dyeings of cotton and acetate or polyester fabrics were made to determine the cross staining of a range of wt %. of polymer in the second component of the present invention. Suitability as a reserving agent was measured on the AATCC Grey Scale of Class 1–5 with 5 being best.

TABLE 4

Polymer Wt % (2nd Component) Dye Trial Results

| Example | Polymer Wt % | Grey Scale |
|---|---|---|
| 23 | 0.0 | 3 |
| 24 | 0.1 | 4 |
| 25 | 0.5 | 5 |
| 26 | 1.0 | 5 |
| 27 | 5.0 | 5 |
| 28 | 10.0 | 4 |
| 29 | 15.0 | 3 |

These results clearly show that a polymer of the present invention in the second component having a wt % between about 0.1 to 10 provides the highest resistance to cross staining.

The amount of PVP in the first component of the present invention can be varied between a low of about 0.1 to a high of about 30 wt % with 5 wt % being most preferred.

The amount of PVP in the second component of the present invention can be varied between a low of about 0.1 to a high of about 10 wt % with 5 wt % being most preferred.

The present invention provides a reserving agent that can be used at between about 0.1 to 0.5% on weight of fabric (OWF) in dyeing machines with liquor ratios from 1:1 up to 100:1. At higher liquor ratios, a higher OWF may be necessary for acceptable yield.

Certain modifications and improvements will occur to those skilled in the art upon reading of the foregoing description. It should be understood that all such modifications and improvements have been deleted herein for the sake of conciseness and readability but are properly within the scope of the following claims.

We claim:

1. A two step composition for the elimination of cellulosic dye cross staining when dyeing cellulosic and synthetic blended fabrics in a dye bath, said composition comprising:

(a) a first liquid part including polyvinylpyrrolidone polymer in an amount between about 0.1 and 30 wt % and the balance water; and (b) a second powdered part including dyestuff including at least one dye and polyvinylpyrrolidone polymer, wherein said polyvinylpyrrolidone polymer is between about 0.1 to 10 wt % of said second part and the balance is said dye.

2. The composition according to claim 1, wherein said dyes are selected from the group consisting of direct and fiber reactive dyes.

3. The composition according to claim 1, wherein said polyvinylpyrrolidone polymer has a mwt. of between about 15,000 to 40,000.

4. A two step composition for the elimination of cellulosic dye cross staining when dyeing cellulosic and synthetic blended fabrics in a dye bath, said composition comprising:

(a) a first liquid part including polyvinylpyrrolidone polymer in an amount between about 0.1 and 30 wt % having a mwt. of between about 15,000 to 40,000 and the balance water; and (b) a second powdered part including dyestuff including at least one dye and polyvinylpyrrolidone polymer, wherein said polyvinylpyrrolidone polymer is between about 0.1 to 10 wt % of said second part and the balance is said dye.

5. The composition according to claim 4, wherein said dyes are selected from the group consisting of direct and fiber reactive dyes.

6. The composition according to claim 4, wherein said polyvinylpyrrolidone polymer in said first component is between about 0.1 to 0.5 wt %.

7. The composition according to claim 4, further including a surfactant.

8. The composition according to claim 7, wherein said surfactant is a nonionic surfactant selected from the group consisting of alcohol ethoxylates, alcohol ethoxylate propoxylates, tert-amine ethoxylates and amphoteric surfactants including amino carboxylates, betaines, and imidazolines.

9. The composition according to claim 4, wherein the pH of said composition is between about 3 to 9.

10. The composition according to claim 4, wherein said polyvinylpyrrolidone polymer in said second part also has a mwt. of between about 15,000 to 40,000.

11. A method for the elimination of cellulosic dye cross staining when dyeing blended fabric of cellulose and polyester and/or acetate in a dyebath, said method comprising adding a composition according to claim 1 to the dyebath.

* * * * *